US009969479B2

(12) United States Patent
De Bruin et al.

(10) Patent No.: US 9,969,479 B2
(45) Date of Patent: May 15, 2018

(54) HYDRAULIC STEERING ARRANGEMENT FOR A THRUSTER OF A MARINE VESSEL

(75) Inventors: Jan Kees De Bruin, Eindhoven (NL); Rik Roemen, Oisterwijk (NL); Bart Van Der Ven, Waspik (NL)

(73) Assignee: WARTSILA FINLAND OY, Vaasa (FI)

( * ) Notice: Subject to any disclaimer, the term of this patent is extended or adjusted under 35 U.S.C. 154(b) by 517 days.

(21) Appl. No.: 14/343,948

(22) PCT Filed: Sep. 9, 2011

(86) PCT No.: PCT/FI2011/050773

§ 371 (c)(1),
(2), (4) Date: May 29, 2014

(87) PCT Pub. No.: WO2013/034797

PCT Pub. Date: Mar. 14, 2013

(65) Prior Publication Data

US 2014/0299030 A1 Oct. 9, 2014

(51) Int. Cl.
*F15B 11/00* (2006.01)
*B63H 25/22* (2006.01)

(52) U.S. Cl.
CPC ..... *B63H 25/22* (2013.01); *F15B 11/003* (2013.01); *F15B 2211/50527* (2013.01)

(58) Field of Classification Search
CPC ..... F15B 11/003; F15B 2211/50527
See application file for complete search history.

(56) References Cited

U.S. PATENT DOCUMENTS

| | | | | |
|---|---|---|---|---|
| 4,522,109 | A * | 6/1985 | Marchi | E02F 9/226 91/420 |
| 4,878,864 | A | 11/1989 | Van Bentem | |
| 5,018,935 | A * | 5/1991 | Gage | F15B 13/01 137/106 |
| 5,183,071 | A * | 2/1993 | Ogawa | F15B 13/01 137/106 |
| 6,938,719 | B2 * | 9/2005 | Ishimaru | B60W 10/06 180/305 |
| 2006/0278152 | A1 | 12/2006 | Nickerson | |

FOREIGN PATENT DOCUMENTS

| | | |
|---|---|---|
| JP | 52077397 A | 6/1977 |
| SU | 738944 | 5/1980 |

OTHER PUBLICATIONS

Decision on Grant dated Apr. 13, 2015 from corresponding Russian application No. 2014113854/11(021666), filed Sep. 9, 2011.
International Search Report for PCT/FI2011/050773 dated Apr. 4, 2012.

* cited by examiner

*Primary Examiner* — F. Daniel Lopez
(74) *Attorney, Agent, or Firm* — Heslin, Rothenberg Farley & Mesiti, P.C.; Victor Cardona, Esq.

(57) ABSTRACT

A novel design of a hydraulic steering arrangement for a thruster of a marine vessel is specifically designed for thrusters intended to operate in an arctic environment where ice is present. To meet the arctic demands the steering arrangement is provided with a cross-over safety block arranged close to the hydraulic steering motor for absorbing the torque subjected to the thruster by ice for instance.

17 Claims, 7 Drawing Sheets

HYDRAULIC STEERING ARRANGEMENT FOR A THRUSTER OF A MARINE VESSEL

CROSS-REFERENCE TO RELATED APPLICATIONS

This application is a 371 National Phase of PCT International Application No. PCT/FI2011/050773 filed on Sep. 9, 2011, and published in English as WO 2013/034797 A1 on Mar. 14, 2013, the entire disclosure of which is incorporated herein by reference.

TECHNICAL FIELD

The present invention relates to a novel design of a hydraulic steering arrangement for a thruster of a marine vessel. The hydraulic steering arrangement of the invention is specifically designed for thrusters intended to operate in an arctic environment where ice is present. As a consequence, the use and the requirements for the steering arrangement are significantly different compared to the standard steering arrangements for thrusters operating in open waters only.

BACKGROUND ART

A thruster as here understood is a steerable propulsion device arranged mainly beneath the hull of a marine vessel (see FIG. 1). The thruster is formed of a propeller unit (rotatable/steerable round a vertical axis) beneath the hull and of a substantially vertical housing. The vertical housing extends up into the hull of the marine vessel through an opening at the bottom of the hull. The circumference of the opening is provided with means, for instance bearings, for holding the upper end of the vertical housing within the hull. The upper end of the vertical housing is provided with a first gear wheel, which communicates with one or more smaller second gear wheels each rotated by a hydraulic steering motor. The first and second gear wheels form the mechanical components of a gear transmission azimuth steering arrangement. The vertical housing of the thruster is in itself rotatable by means of the first gear wheel and the hydraulic steering motor/s attached to a non-rotary support frame, which supports the thruster to the opening at the bottom of the hull. The drive of the propeller is arranged through the hollow interior of the vertical housing. Thus the drive may be mechanical with drive shafts and angular gears. Naturally the drive of the propeller may also be arranged hydraulically or electrically.

Normally the steering arrangement of a thruster is intended to control the azimuth angle of the unit. The positioning of the mechanical thruster part is done by one or more hydraulic motors. JP52-77397 (Kawasaki Heavy Industries) for instance discusses a traditional hydraulic steering arrangement of a thruster. A proportional directional valve controls the oil flow from the hydraulic pump to the hydraulic steering motor. Once the correct azimuth angle is reached, the proportional valve is used to close the flow connection from the pump to the hydraulic motor as well as from the hydraulic motor back to the oil tank. The azimuth angle of the thruster is then maintained as both flow paths from the hydraulic motor are closed and the motor is, thus, not able to rotate.

A somewhat more detailed illustration of a hydraulic steering arrangement of a thruster is shown in FIG. 2. The major difference when compared to the steering arrangement of the JP document 52-77397 is the counterbalance block, which is arranged between the pilot-operated proportional directional valve and the hydraulic steering motor turning the thruster. The counterbalance block includes a safety valve arrangement and two, i.e. a first and a second, counterbalance valve arrangements. The purpose of the safety valve is to open a flow path from one port of the hydraulic motor, if the pressure at this port exceeds a predefined allowable value. The pressurized oil flows to the safety valve, opens the valve at the predefined set point of the safety valve, and passes to the pipe of the hydraulic motor prevailing at a lower pressure, or returns from the outlet port to the tank.

The counterbalance valve arrangements have been coupled to the hydraulic pipes connected to the ports of the hydraulic motor farther away than the safety valve arrangement. The counterbalance valve arrangement includes a check valve and a hydraulically operated pressure relief valve. The purpose of the counterbalance valve arrangements is to lock the steering i.e. maintain the thruster in the direction it has been turned by the proportional valve with the help of the hydraulic steering motor/s. At a steering phase the counterbalance valve arrangements function as follows. The first valve arrangement positioned at the inlet pipe of the steering motor/s allows the pressurized oil to flow via the check valve to the inlet port of the steering motor/s with a minimal pressure loss. In the second valve arrangement at the outlet pipe of the steering motor/s the pressure of the returning oil affects the pressure relief valve and opens it together with the pilot pressure from the pressure pipe between the proportional directional valve and the first counterbalance valve arrangement. Thus the returning oil has a certain counter pressure, i.e. a pressure loss takes place in the second counterbalance valve. When the steering action is stopped for maintaining the thruster at its direction, the proportional directional valve is moved to its centre position whereby the proportional valve forms a connection from the counter balance valves to the tank. Thus the connection from the pump to the counterbalance valve is closed. In such a case the steering motor/s is/are subjected to no internal load. However, the thruster may be subjected to external loads from the sea, whereby the thruster acts on the steering motor/s and tries to rotate such. In practice this means that the motor/s start/s acting as pump/s. The motor/s create/s oil pressure that acts on both the safety valve and one of the counterbalance valves of the counterbalance block. As long as the hydraulic motor/s has/have no internal leakage the thruster is not able to turn until the pressure exceeds the predetermined value required to open the safety or counterbalance valve. When the value is exceeded the pressurized oil flows from the outlet port of the steering motor/s to the inlet port/s or to the tank.

However, now that the thrusters have gained acceptance in marine vessels that are used in arctic conditions, too, the loads, and especially the torque ice subjects to thrusters have to be taken in careful consideration. The torque exerted by ice loads on the thrusters may reach an unacceptable magnitude for the structure of the thrusters or the entire steering arrangement. As discussed above the prior art hydraulic steering arrangements have safety valves aiming at taking care of the oil flows and pressures related to hydrodynamic loading with a limited safety margin only.

However, the prior art safety valves have not been designed and positioned in view of the sudden loads created by hard and large solid objects like for instance ice. The loads associated with contact with ice have a profound dynamic character. A typical aspect is that these loads can lead in a very short time to a torque load on the steering system above a value the construction can accommodate. Also if the vessel containing the thruster is sailing at a certain speed at the moment the thruster comes in contact with ice the speed at which the ice block (or other large solid object) tries to rotate the thruster is easily 5 to 10 times the normal steering speed. The forced rotation of the thruster results in the hydraulic motors acting as pumps and generating a flow significantly larger, also 5 to 10 times, than the one required for steering purposes. The prior art safety valves have been selected to accommodate a flow corresponding to the normal steering speed upon blockage of the steering system. The same is true for the dimensioning of the oil pipes between the hydraulic motors and the safety valve. Also the positioning of the valves arranged at, possibly, a considerable distance from the steering motor/s has been based on the requirements associated with the steering purposes. In other words, the main design parameter has been the requirement of the steering of the thruster that its speed of rotation is of the order of 2 rpm whereby the oil pipes to and from the steering motor/s should be able to handle such flows. On the one hand, when the hydraulic steering system is subjected to the significantly increased flows as generated by the hydraulic motors the limited diameter of the piping results in high flow velocities within the pipes, whereby the oil friction in the pipes creates a substantial pressure loss within the entire hydraulic pipeline between the hydraulic motor and the safety valve. The maximum pressure within the steering system is limited by the maximum mechanical strength of the steering system or thruster with respect to the torque load. A higher load leads to damage of the steering system or the thruster. Given the maximum allowable torque or pressure on the steering system, the pressure loss within the piping would require a lower setting of the safety valve. In other words, the higher rotational speeds of the thruster are desired to be taken into account, the lower the opening pressure of the safety valve should be. The lowering of the opening pressure of the safety valve would however interfere with the normal steering operation. In a similar manner the quick rotation of the hydraulic motor/s as pump/s creates in the inlet port of the steering motor/s reduced pressure, which easily leads to non-controlled cavitation, as the pipes leading to the inlet port/s of the hydraulic motor/s do not allow oil to flow quickly enough into the motor/s.

On the other hand, if the hydraulic pipes and safety valve are sized with respect to the maximal imaginable flow, and the distance between the hydraulic motor/s and the counterbalance block, where the pressure relief valve is positioned, is several meters, then the hydraulic pipelines are relative larger volumes. Those volumes may introduce undesired dynamic behavior such as pressure pulses and time delays. Especially in case of large external loads, which appear as impact loads, the undesired dynamic phenomena may occur. Pressure pulses are highly undesired as they can cause chattering of the pressure relief valve, i.e. the valve opens and closes in very short time periods. This may result in damage for the pressure relief valve and hydraulic motor. Also, for normal steering operations, pressure pulses and time delay may influence the steering behavior in a negative way such that the steering movement is non-smo.

BRIEF SUMMARY OF THE INVENTION

A first object of the present invention is to offer a solution to one or more of the above discussed problems.

A second object of the present invention is to suggest an improvement in the hydraulic steering arrangement of a thruster. The main part of the hydraulic system remains unchanged (or can even be made smaller or simplified), which means the dynamic behavior for normal steering remains the same. The position of the pressure relief valve is as close to hydraulic motor as possible such that high pressure introduced by large loads is relieved as soon as possible, which is a good measure to prevent the origination of pressure waves.

A third object of the present invention is to provide the hydraulic steering arrangement of a thruster with safety valve/s located as close to the hydraulic motor/s as practically possible.

A fourth object of the present invention is to provide the hydraulic steering arrangement of a thruster with a combination of a counter balance valve block and a set of cross-over safety valves arranged close to the hydraulic steering motor.

A fifth object of the present invention is to dimension the cross-over safety valves to allow a high rotation speed of the steering units while maintaining system pressure within acceptable limits.

A sixth object of the present invention is to provide the hydraulic steering arrangement of a thrusters with steering motors, which may be operated as a brake during an overload of the steering arrangement.

At least one of the above and other objects of the invention are met by a hydraulic steering arrangement for a thruster of a marine vessel, the steering arrangement comprising a hydraulic oil tank, at least one hydraulic pump, a control valve block, a counterbalance block, at least one hydraulic motor having two ports for the hydraulic oil the at least one hydraulic motor being used for steering the thruster, wherein a cross-over safety block is arranged in close communication with the at least one hydraulic motor.

Other characteristic features of the present will become apparent from the appended dependent claims.

The present invention, when solving at least one of the above-mentioned problems, improves the operability and reliability of marine vessels especially in arctic waters where ice may be present. The cross-over safety block makes sure that the thrusters start rotating before the torque acting on the steering arrangement becomes unacceptable. An important aspect is that the pressure increase created by the ice in the hydraulic steering arrangement is minimized by arranging the cross-over safety block as close to the hydraulic steering motor/s as possible. A further advantage is that the modifications made in the hydraulic system are limited. The benefit of this is that the dynamic properties of the system for normal operation remain more or less unaffected.

BRIEF DESCRIPTION OF DRAWING

In the following, the hydraulic steering arrangement of a thruster is explained in more detail with reference to the accompanying Figures, of which

DETAILED DESCRIPTION OF DRAWINGS

Figure 1:
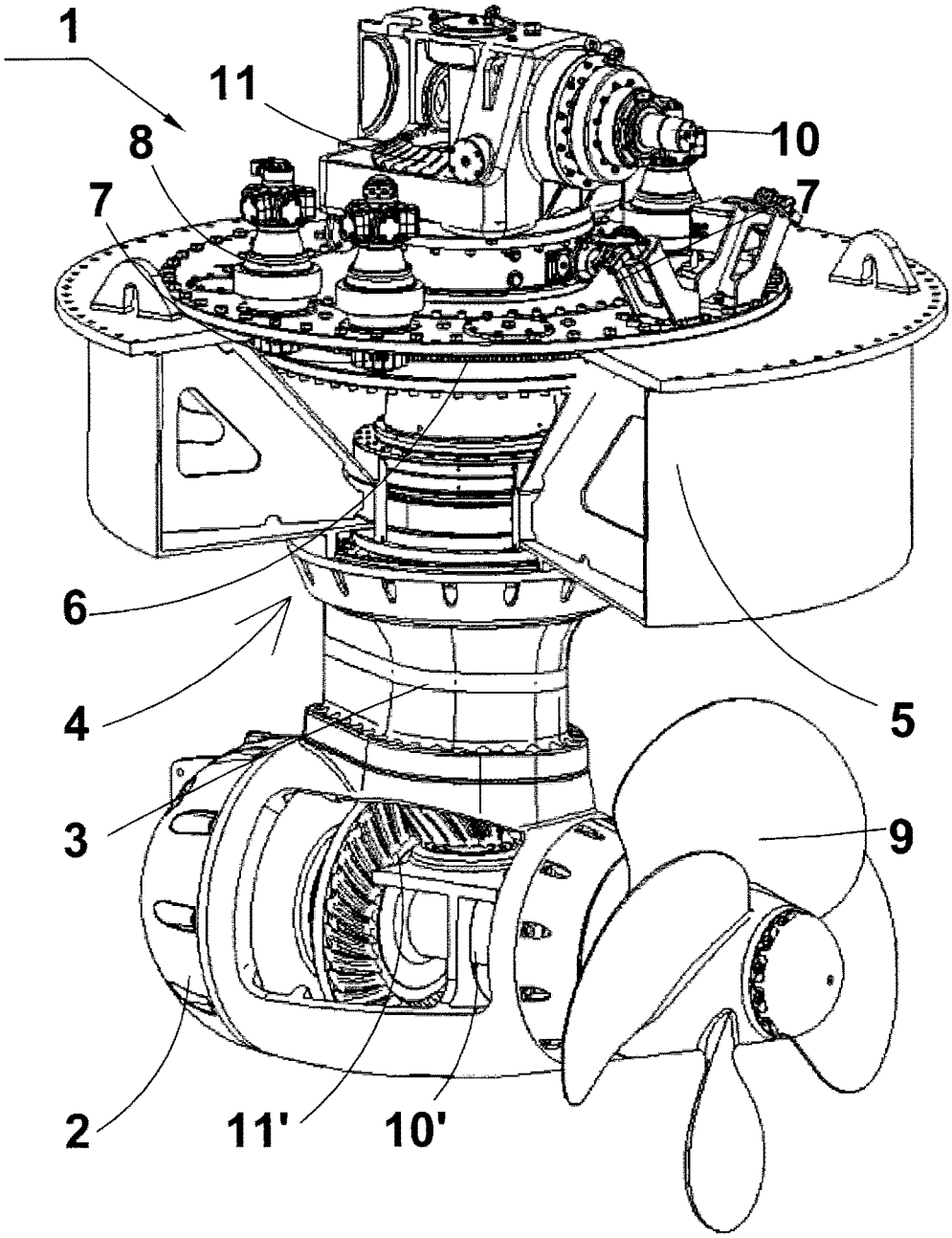
Fig. 1 (Prior Art)
FIG. 1 illustrates schematically a prior art thruster with its steering arrangement.

FIG. 1 illustrates a state-of-the-art thruster 1, which is here understood as a steerable propulsion device arranged mainly beneath the hull (not shown) of a marine vessel. The thruster 1 is formed of a propeller unit 2 (rotatable/steerable round a vertical axis) beneath the hull and a substantially vertical housing 3. The vertical housing 3 extends up into the hull of the marine vessel through an opening 4 in the bottom of the hull. The upper end of the vertical housing 3 is arranged rotatable by means of bearings within a round support frame 5 that is attached to the hull bottom such that it fills the opening 4. The upper end of the vertical housing 3 is provided with a first gear wheel 6, which communicates with one or more smaller second gear wheels 7 each rotated by a hydraulic steering motor 8 attached to the support frame 5. Normally several hydraulic motors will be present for redundancy and sizing reasons. The first and second gear wheels, 6 and 7, respectively, form the mechanical components of a gear transmission azimuth steering arrangement. The vertical housing 3 of the thruster 1 is in itself rotatable by means of the hydraulic steering motor/s 8. The drive of the propeller 9 is arranged through the hollow interior of the vertical housing 3. Thus the drive of the propeller is mechanical with drive shafts 10, 10' and angular gears 11, 11'. However, the hydraulic steering arrangement of the invention may be used with hydraulic or electric drives, too.

Figure 2:
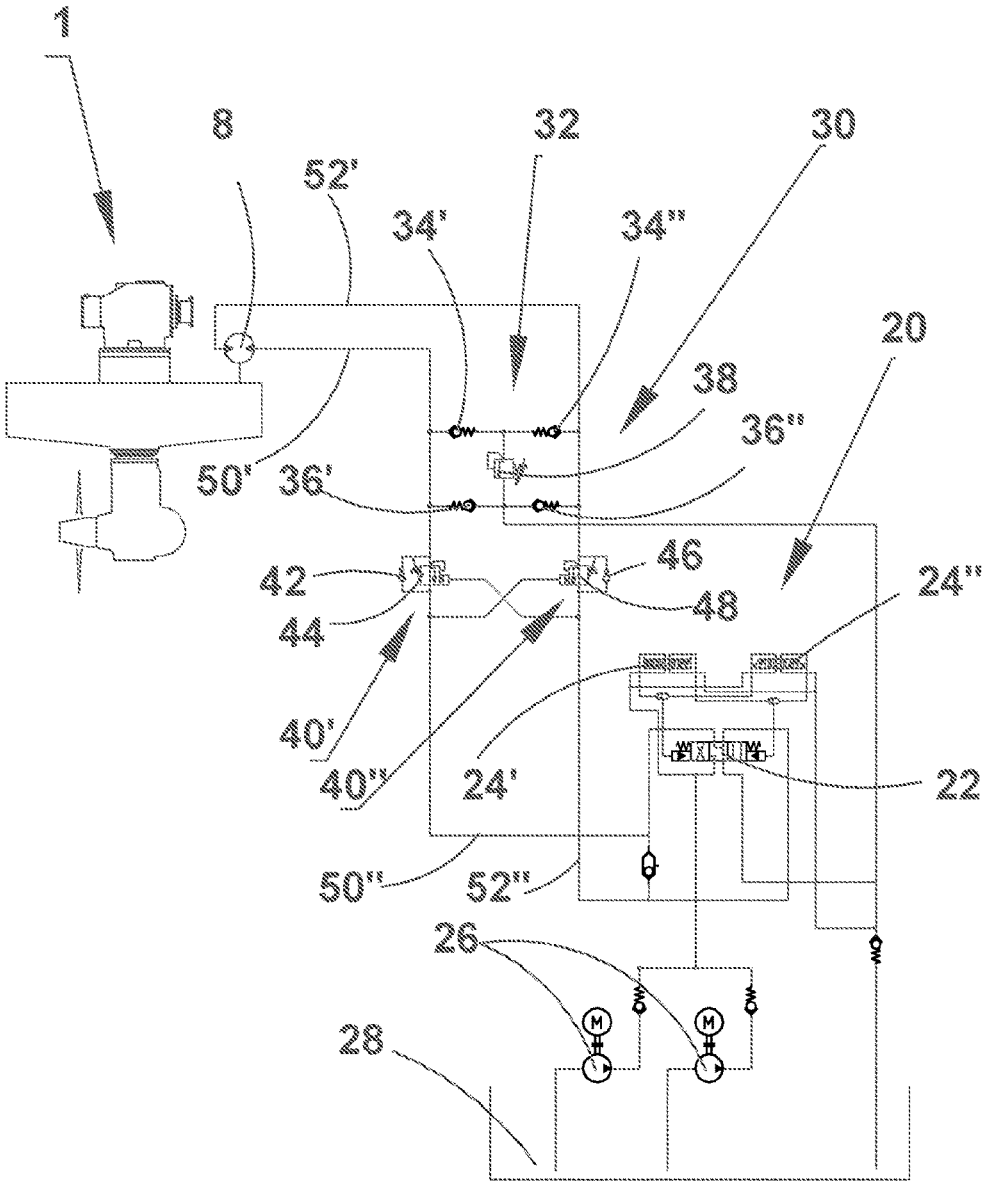
Fig. 2 (Prior Art)
FIG. 2 illustrates schematically a prior art steering arrangement of a thruster.

FIG. 2 illustrates schematically the hydraulic instrumentation of a prior art steering arrangement of a thruster 1. The major difference when compared to the steering arrangement of the earlier discussed JP document is the safety and counterbalance block 30, which is arranged between the thruster control block 20 and the hydraulic motor 8 turning the thruster 1. Thus the control block 20 performs essentially the same functions as the proportional valve in the JP document.

The control block 20 of the thruster 1 comprises a proportional directional valve 22 (4 ports, 3 positions) Depending on the flows and pressures applied the operation of the valve may be performed with pilot operated valves. The hydraulic steering arrangement has at least one hydraulic pump 26 for pressurizing the oil stored in the hydraulic oil tank 28. Normally the number of hydraulic pumps 26 is at least two, for instance for safety and redundancy purposes. In such a case, one pump may be capable of fulfilling the need of oil of all the consumers, or both pumps may be used simultaneously. In non-steering conditions the proportional valve (and the optional pilot valves) is in neutral position blocking oil flow through the valves, whereby the oil pressure created by the pump/s 26 acts on the valves only. When the direction of the thruster 1 needs to be changed the proportional valve is moved to the desired direction. Now a flow communication from the pump/s 26 towards the steering motor 8 is opened resulting in rotation of the steering motor 8 and turning of the thruster 1. The oil flow returning from the steering motor 8 flows through the proportional directional valve 22 back to the oil tank 28. When the desired azimuth angle of the thruster 1 is reached the proportional directional valve 22 is then returned to its neutral position. As a result it is blocking the oil flow from the pump/s 26 to the steering motor 8. This function locks the steering angle of the thruster (assuming negligible leakage from the hydraulic motor).

The safety and counterbalance block 30 includes a safety valve arrangement 32 and two, i.e. a first and a second, counterbalance valve arrangements 40' and 40". The purpose of the safety valve arrangement 32 is to open a flow path from one port of the hydraulic steering motor 8 to the other port thereof in such a case that the motor 8, for some reason, starts acting as a pump and raises pressure in one of its ports. The safety valve arrangement 32 is formed of four check valves 34', 34" and 36', 36" and a safety or pressure relief valve 38. When the motor 8 acts as a pump and creates an oil pressure exceeding the predetermined opening pressure of the safety valve 38 one of the first two check valves 34' and 34" i.e. one of the two check valves 34' and 34" (depending in which direction the motor is rotated) in the flow paths between the hydraulic motor 8 and the safety valve 38 opens and as a result, the oil flows through the safety valve 38, passes one of the second check valves 36' and 36" and enters the pipe of the hydraulic motor 8 prevailing at a lower pressure, i.e. the one acting as the inlet pipe of the hydraulic motor.

The first and second counterbalance valve arrangement 40' and 40" have been coupled farther away than the safety valve arrangement 38 to the hydraulic pipes 50 and 52 connected to the ports of the hydraulic steering motor 8. The first counterbalance valve arrangement 40' includes a check valve 42 and a pilot-operated pressure relief valve 44 and the second counterbalance valve arrangement 40" includes a check valve 46 and a pilot-operated pressure relief valve 48. The purpose of the counterbalance valve arrangements 40' and 40" is to lock the steering i.e. maintain the thruster 1 in the direction it has been turned by the hydraulic steering motor/s 8 controlled by the proportional directional valve 22. In other words, the counterbalance valve arrangements 40' and 40" take the pressure load, if the hydraulic motor 8 starts to act as a pump, whereby the proportional directional valve 22 is not subjected to any pressure load from the direction of the hydraulic motor 8.

At a steering phase the counterbalance valve arrangements 40' and 40" function as follows assuming that a first pipe portion 50' and a second pipe portion 50", allows oil flow to the motor and pipe 52 takes care of the return flow. The first valve arrangement 40' positioned at the inlet pipe 50 of the steering motor/s 8 allows the pressurized oil to flow via the check valve 42 to the inlet port/s of the steering motor/s 8 with a minimal pressure loss. In the second valve arrangement 40" the pressure of the returning oil at the first outlet pipe portion 52' of the steering motor/s 8 affects the pilot-operated pressure relief valve 48 and opens it, assisted by the pilot pressure from the pressure pipe 50" between the proportional directional valve 22 and the pilot-operated pressure relief valve 44. Thus the returning oil has a certain counterpressure, i.e. a pressure loss takes place in the second counterbalance valve arrangement 40".

When the desired thruster direction, i.e. angular position is reached, and the steering action thus ceased the thruster is maintained at its desired direction. As explained already above, the proportional directional valve 22 is moved to its neutral position whereby no flow through the proportional valve 22 takes place from the supply side to the hydraulic motor side. However, due to the presence of the counterbalance valve arrangements it is not the proportional directional valve 22 that prevents the steering motor from rotating, as is the case in the steering arrangement of the above cited Japanese reference, but the counterbalance valve arrangements 40' and 40". In this case the steering motor/s 8 is/are subjected to no internal load. However, the thruster 1 may be subjected to external loads from the sea or any objects therein, whereby the thruster 1 acts on the steering motor/s 8 through the steering gear transmission (discussed in connection with FIG. 1) and tries to rotate such. In practice this means that the motor/s 8 start/s acting as pump/s. The motor/s 8 create/s oil pressure that acts on both the safety valve 38 and one of the pilot-operated pressure relief valves 44, 48. As long as the hydraulic motor/s 8 has/have no internal leakage the thruster 1 is not able to turn until the pressure the steering motor/s 8 has/have succeeded in creating in front of the safety valve 38 exceeds its predetermined opening value. When the value is exceeded the pressurized oil flows from the outlet port/s of the steering motor/s 8 to the inlet port/s thereof via two check valves and the safety valve 38. Thus the opening pressure of the safety valve 38 is lower than that of the pilot-operated pressure relief valves 44, 48. It should be noted that the pilot pressure of the pilot-operated pressure relief valves 44, 48 is negligible (the proportional directional valve 22 being in neutral position).

Figure 3:
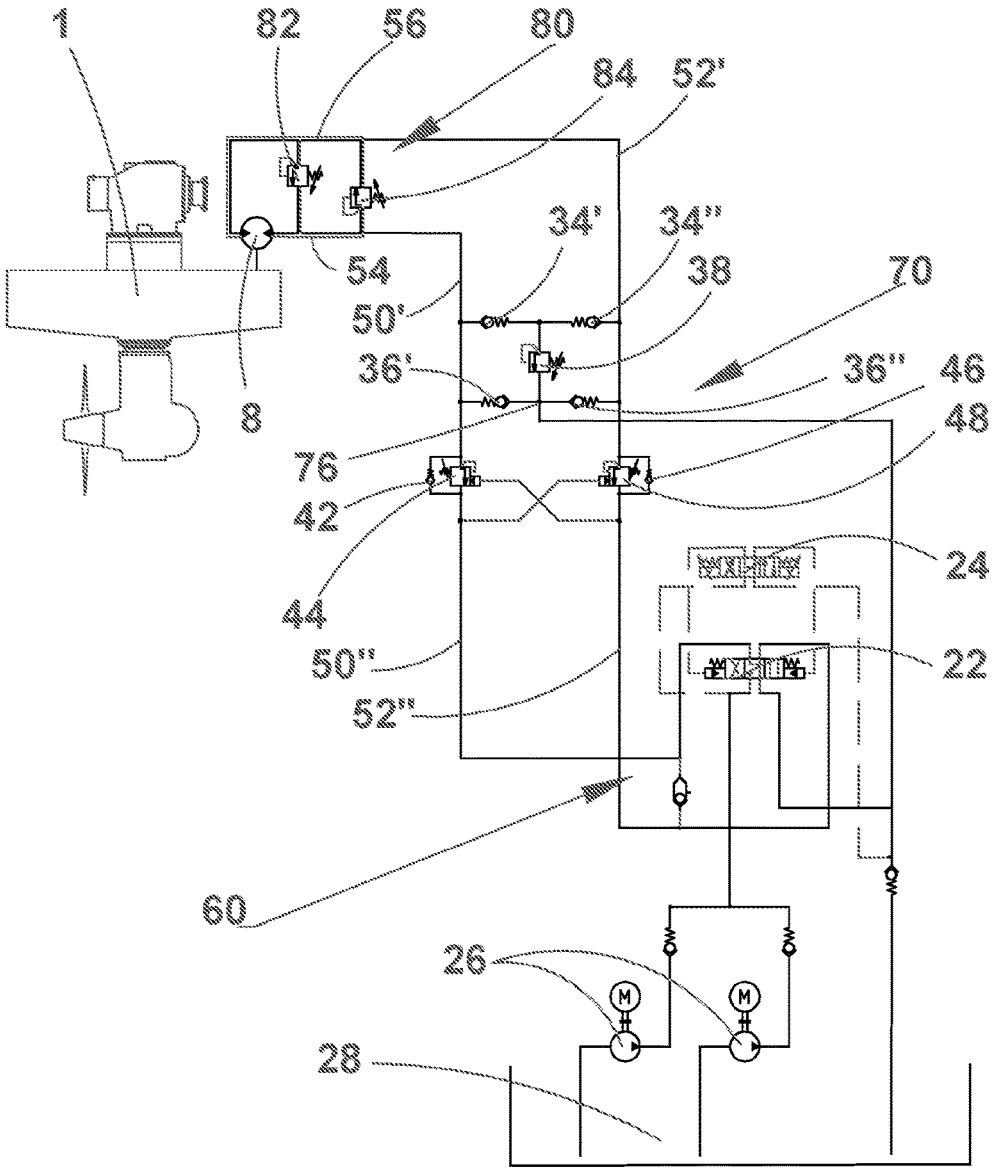
FIG. 3 illustrates schematically a first preferred embodiment of the steering arrangement of the present invention.

In FIG. 3 the hydraulic steering arrangement of a thruster 1 in accordance with a preferred embodiment of the present invention is illustrated. The hydraulic steering arrangement consists of four main parts, which are physically grouped together, i.e. a hydraulic powerblock 60, a counterbalance block 70, a cross-over safety block 80, and the hydraulic steering motor 8. The general construction and function of the hydraulic powerblock 60, the counterbalance block 70 and the hydraulic steering motor 8 are known before and have been discussed in more detail above in connection with FIG. 2.

The hydraulic powerpack 60, thus, contains hydraulic pumps 26, an oil tank 28, and the control block (discussed in connection with FIG. 2) including a proportional directional valve 22 as its main component. The proportional directional valve 22 may optionally be operated by means of at least one proportional directional solenoid valve 24. The two pumps 26 shown in FIGS. 2 and 3 may be sized as two times 50% of the required flow or as two times 100%, which means that just one pump will be active and the other pump is redundant. However, if considered worthwhile the number of hydraulic pumps of the hydraulic steering arrangement may exceed two. The function of the hydraulic powerpack 60 is to supply oil to the hydraulic steering motors 8. Depending on the position of the proportional directional valve 22, a certain flow is supplied by the hydraulic powerpack 60. The required load pressure is automatically generated (the means not shown) up to the safety pressure setting of the powerpack 60.

The counterbalance block 70 contains the counterbalance valves, i.e. the pilot-operated pressure relief valves 44 and 48, the check valves 42 and 46 in cooperation therewith, the pressure relief valve, i.e. the safety valve 38 with its check valves (34', 34", 36' and 36") and the cavitation protection system 76 utilizing check valve 36' or check valve 36".

The counterbalance block 70 has three functions. The main function is accomplished by the counterbalance valves, i.e. the pilot-operated pressure relief valves 44 and 48 and the check valves 42 and 46 in cooperation therewith. For instance, a path to the hydraulic motor/s 8 is arranged via a check valve 42 i.e. with a low pressure drop. However, the return path back to the proportional directional valve 22 is arranged via a pilot-operated pressure relief valve 48, i.e. with a large pressure drop. In fact, the counterbalance block 70 shown in FIG. 3 has two pilot-operated pressure relief valves 44 and 48. The valves are for all hydraulic steering motors 8 together. In other words, one counterbalance block is used for one thruster, i.e. controlling oil flows to all steering motors of a thruster. As another option, it would also be possible to arrange a counterbalance block for a certain number of steering motors. For instance for a thruster using six steering motors one might have two or three counterbalance blocks, each serving three or two steering motors. A relatively high pressure is needed to open the return path via the pilot-operated pressure relief valve 44 or, in the above example, via the pilot-operated pressure relief valve 48. The pressure that opens the return path is the combination of the load pressure (pressure of the returning oil) and the pressure in the forward path (flowing from pilot-operated pressure relief valve 44 towards the steering motors 8), which is called the pilot pressure. If the purpose is to rotate the hydraulic motors 8, then the pilot pressure will be considerable high, as well as the load pressure and consequently, the counterbalance valve, i.e. the pilot-operated pressure relief valve 48 in the return oil path will open. If the purpose is to hold the hydraulic steering motors 8 in place, i.e. not rotate the thruster 1, then the pilot pressure will be low because there is an open connection through the proportional directional valve 22 to the oil tank 28 when the proportional directional valve 22 is in centre i.e. neutral position. In that case, only the load pressure is present to open the pilot-operated pressure relief valves 44 and 48. To be able to open the pilot-operated pressure relief valves 44 and 48 the load pressure should be significantly higher as it should suffice without the help of the pilot pressure. This concept is used to maintain the angular positions of the hydraulic steering motors 8. This function is also required by the classification society, which requires that in case of failure in the powerpack 60, the thruster 1 must maintain its position.

Another function of the counterbalance block 70 is the pressure relief in case of too high pressure prevailing in one of the pipe portions 50' or 52' coming from the steering motor 8. A certain pressure makes the pressure relief valve, i.e. the safety valve 38 open so that oil may flow to the oil tank 28 or to the other pipe portion 52' or 50'.

The third main part is the hydraulic steering motor 8, which is connected to the gear transmission and mounted on the support frame (as shown in FIG. 1). Normally several hydraulic steering motors 8 will be present for redundancy and sizing reasons. The three parts 60, 70 and 8 are connected by oil pipes. Normally, after the counterbalance block 70, the oil pipes will have several pipe portions to the hydraulic motors 8, i.e. there is one counterbalance block 70 for one thruster 1. The hydraulic powerpack 60 and the counterbalance block 70 are not necessarily mounted on the thruster 1; preferably they are arranged at a distance thereof. The hydraulic steering motors 8 convert the oil flow to a rotational velocity of a shaft.

The hydraulic powerpack 60 and the counterbalance block 70 are sized to handle the flow corresponding to a desired thruster steering speed of around 2 rpm (hydraulic motors 8 will naturally rotate faster because of the steering gear transmission). Since the thruster steering speed may be imposed by an ice block or some other solid object and this speed may be much higher than the design steering speed, the steering arrangement of the present invention has been provided with a cross-over safety block 80. The safety block 80 comprises pressure relief valves 82 and 84, which are preferably arranged as close to the steering motor 8 as practically possible. In other words, the cross-over safety block 80 is preferably attached to the hydraulic motor 8. In case one safety block 80 is coupled to several hydraulic motors the safety block is preferably arranged so that the cross-over oil passage lengths between the motors and the block are minimized. The pressure relief valves 82 and 84 are sized to handle a much larger flow than the corresponding pressure relief valves 38, 44 and 48 in the counterbalance block 70. The main reason for this kind of sizing is the goal to keep the hydraulic oil pressure at an acceptable level in the entire hydraulic arrangement, and to prevent pressure pulses and their negative effects in the hydraulic steering arrangement.

The cross-over safety block 80 comprises further two cross-over oil passage 54 and 56, which are connected at their one ends to the ports of the hydraulic motor 8 and at their opposite ends to the pressure relief valves 82 and 84. The cross-over oil passage 54 and 56 have a diameter allowing high volumetric flows from the hydraulic motor 8 to the pressure relief valves 82 and 84 and from these valves back to the motor 8. The dimensioning of the cross-over oil passage 54 and 56 is to be based on a significant higher flow capacity, 5- to 10-fold compared to the hydraulic pipe portions 50' and 52' branching from the cross-over oil passage 54 and 56 and connecting the cross-over safety block 80 to the counterbalance block 70. Thus the hydraulic pipe portions 50' and 52' may be dimensioned as in prior art hydraulic steering arrangements. The higher flow capacity of the cross-over oil passage 54 and 56 ensure that the pressure in said cross-over oil passage is maintained within acceptable limits.

The cross-over safety block 80 functions as follows: Once the hydraulic steering arrangement, normally due to ice or some other solid object tending to turn the thruster 1, is subjected to an unacceptable load whereby the hydraulic steering motors 8 are driven and rotated by the load, i.e. the hydraulic steering motors 8 start operating as pumps, one of the cross-over safety valves, for instance pressure relief valve 82, opens. Thus, the flow generated by the hydraulic steering motors 8 goes through one of the cross-over safety valves 82 and 84. The obtainable steering speeds, when the hydraulic motors 8 are driven mechanically, i.e. by the thruster 1, are easily higher than the steering speeds, which are normally imposed by the hydraulic motors 8. It has been estimated that such a speed may easily be 5-fold, and sometimes even 10-fold compared to ordinary steering speed. Thus both the pressure relief valves 82 and 84 as well as the cross-over oil passage 54 and 56 of the cross-over safety block 80 are dimensioned to 5-fold, preferably to 10-fold volumetric flows compared to pipes 50' and 52' leading from the cross-over safety block 80 to the counterbalance block 70, for instance.

The safety valve 38 in the counterbalance valve block 70 is optional. The flow capacity required during ice contact of the complete hydraulic system is increased by adding the valve. The setting of the valves should be slightly higher than that of the cross over safety valves 82 and 84 on the steering motors. The sizing of the cross-over safety valves i.e. the pressure relief valves 82 and 84 close to the hydraulic motors 8 and the optional safety valve 38 in the counterbalance block is made in such a way that the pressure increase within the hydraulic steering arrangement is restricted to a limited value.

Given the pressure settings on the pressure relief valves 82 and 84 the hydraulic motors 8 need to generate a significant pressure to be able to open one of the valves and thus to enable the oil flow through the valve. A beneficial result is that the hydraulic motors 8 need to be rotated by a significant load moment to enable the rotation. The hydraulic motors still generate a torque opposing the external ice load. The hydraulic motors 8 act, thus, as brakes. As a consequence the azimuth rotation speed of the arrangement is, to a certain degree, limited.

Figure 4:
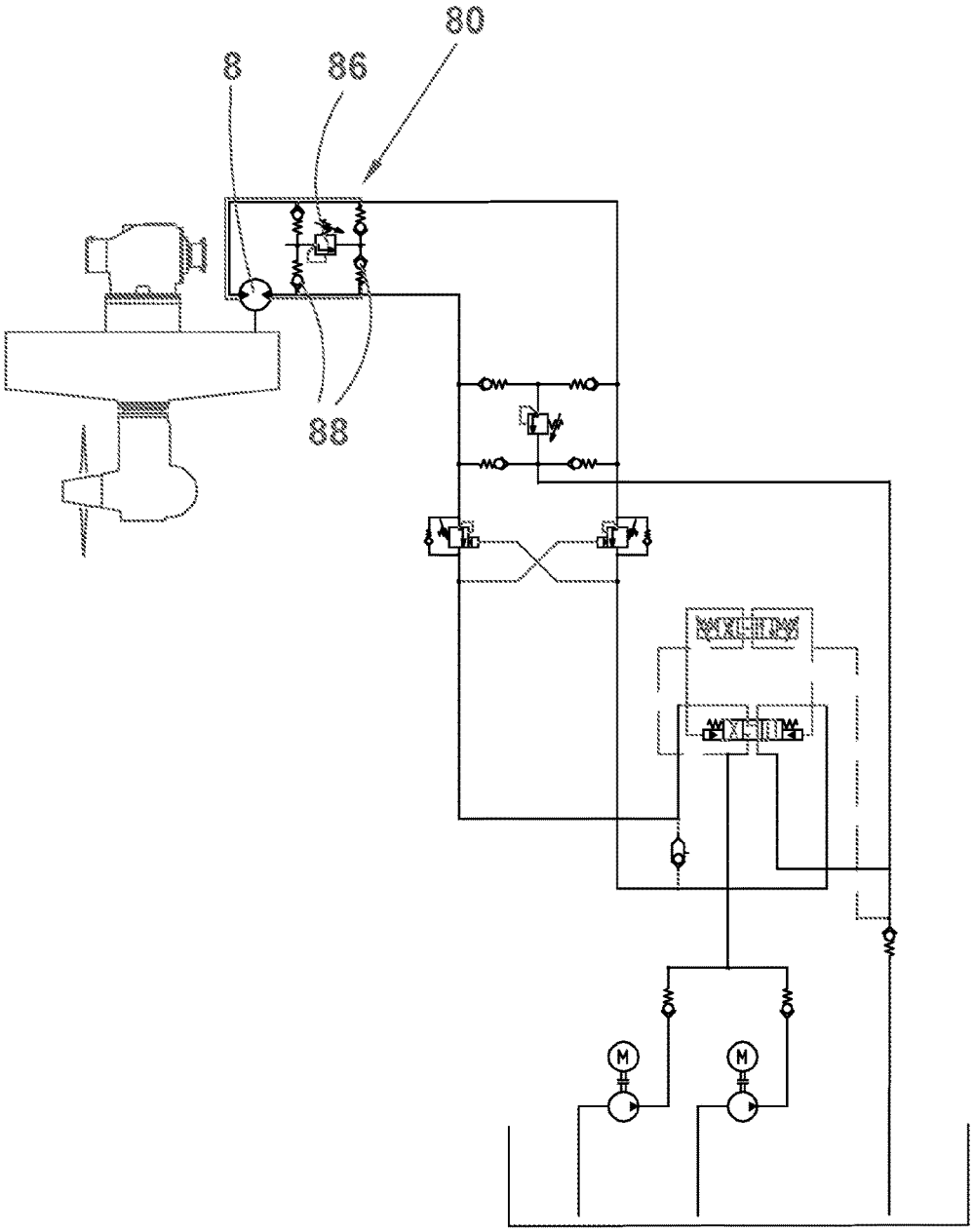
FIG. 4 illustrates schematically a second preferred embodiment of the steering arrangement of the present invention.

In FIG. 4 the hydraulic steering arrangement of a thruster in accordance with a second preferred embodiment of the present invention is illustrated. In this embodiment the design of the cross-over safety valve block 80 has been changed compared to the embodiment discussed in FIG. 3. Otherwise the second embodiment corresponds to the first one, i.e. the one illustrated in FIG. 3. Here, the cross-over safety valve block 80 comprises only one safety valve 86, and four check valves 88 by means of which the pressurized oil from the hydraulic motor 8 is directed to the safety valve 86, and from the safety valve 86 back to the hydraulic motor 8 irrespective of the direction of rotation of the hydraulic motor 8.

Figure 5:
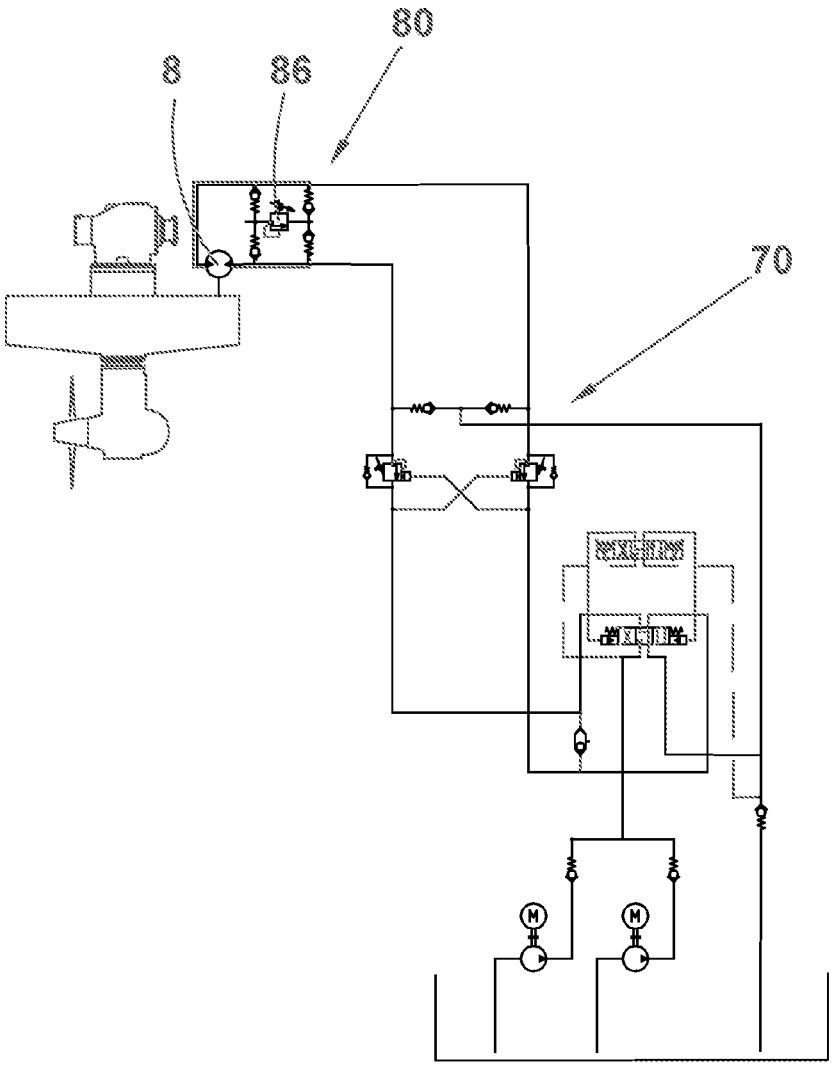
FIG. 5 illustrates schematically a third preferred embodiment of the steering arrangement of the present invention.

In FIG. 5 the hydraulic steering arrangement of a thruster in accordance with a third preferred embodiment of the present invention is illustrated. The steering arrangement of this embodiment is shown to be similar with the second embodiment of the present invention discussed in FIG. 4. The basic idea in this embodiment is that the counterbalance valve block 70 does not any more need the safety valve 38 (shown in FIG. 3, present also in the embodiment of FIG. 4), as the safety valve 86 is arranged in a safety valve block 80 of its own close to the hydraulic motor 8.

Figure 6:
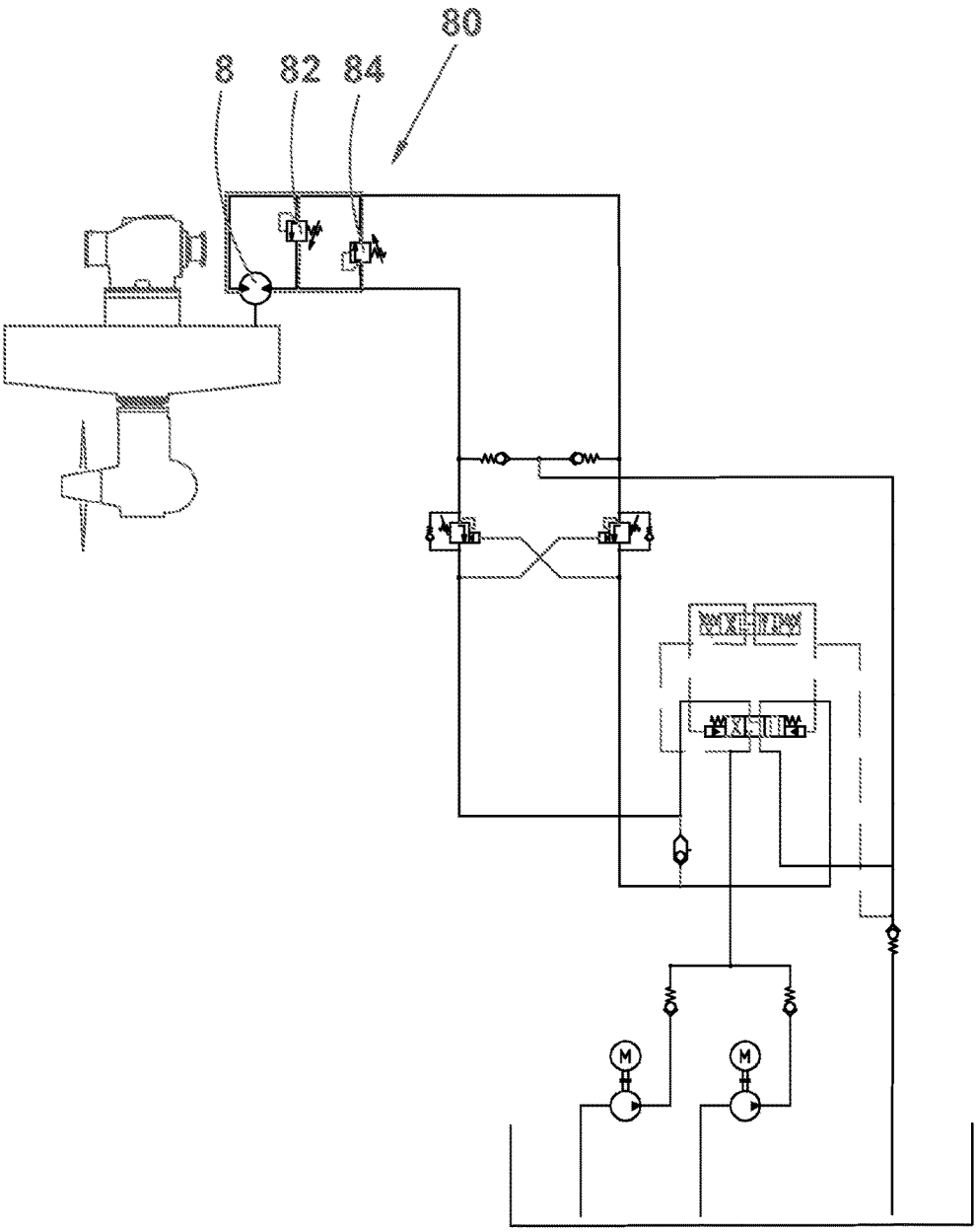
FIG. 6 illustrates schematically a fourth preferred embodiment of the steering arrangement of the present invention.

In FIG. 6 the hydraulic steering arrangement of a thruster in accordance with a fourth preferred embodiment of the present invention is illustrated. The steering arrangement of this embodiment is shown to be similar to the first embodiment discussed in FIG. 3. The basic idea in this embodiment is that the counterbalance valve block 70 does not any more need the safety valve 38 (shown in FIG. 3), as the two safety valves 82 and 84 in FIG. 3 are arranged in a safety valve block 80 of its own close to the hydraulic motor 8.

Figure 7:
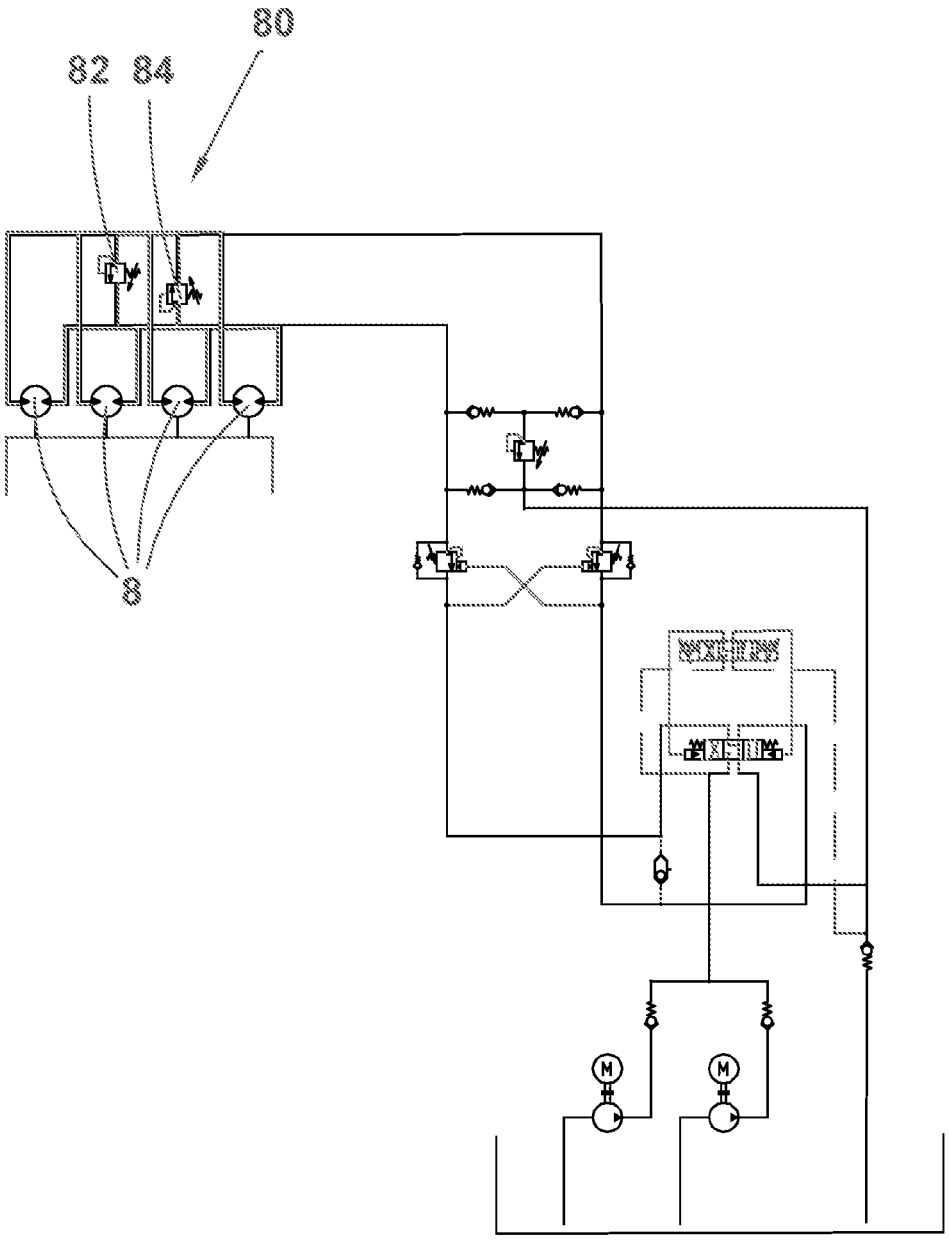
FIG. 7 illustrates schematically a fifth preferred embodiment of the steering arrangement of the present invention.

In FIG. 7 the hydraulic steering arrangement of a thruster in accordance with a fifth preferred embodiment of the present invention is illustrated. Here it has been shown how a number of hydraulic motors 8 arranged for turning a thruster have been provided with a single cross over safety valve block 80 comprising two safety valves 82 and 84. Thus there may be one or more hydraulic motors 8 per safety valve block 80. Naturally, the safety valve block 80 may also be constructed as shown in FIG. 5, i.e. with only one safety valve and a number of check valves. Also, the check valve of the counterbalance block may be taken out, as taught by FIGS. 5 and 6.

It should be understood that the above is only an exemplary description of a novel and inventive hydraulic steering arrangement of a thruster and a method of arrangement. It should be understood that the above description discusses only a few preferred embodiments of the present invention without any purpose to limit the invention to the discussed embodiments and their details only. Thus the above specification should not be understood as limiting the invention by any means but the entire scope of the invention is defined by the appended claims only. From the above description it should be understood that separate features of the invention may be used in connection with other separate features even if such a combination has not been specifically shown in the description or in the drawings.

The invention claimed is:

1. A hydraulic steering arrangement for a thruster of a marine vessel, the steering arrangement comprising:

a hydraulic oil tank arranged in flow communication with at least one hydraulic motor used for steering the thruster via at least one hydraulic pump, the at least one hydraulic motor having ports for a hydraulic oil;

a control valve block;

a counterbalance block, the counterbalance block includes a safety valve; and a cross-over safety block, the cross-over safety block connected to, and in fluid communication with, the counterbalance block by hydraulic pipe portions, the cross-over safety block connected to, and in fluid communication with, ports of the at least one hydraulic motor by cross-over oil passages, the cross-over oil passages dimensioned for higher volumetric flows than the hydraulic pipe portions.

2. The hydraulic steering arrangement as recited in claim 1, wherein the cross-over safety block is arranged on the at least one hydraulic motor at an upper end of the thruster.

3. The hydraulic steering arrangement as recited in claim 1, wherein the cross-over safety block comprises at least one pressure relief valve connected by means of the cross-over oil passages to the ports of the at least one hydraulic motor.

4. The hydraulic steering arrangement as recited in claim 3, wherein the cross-over safety block comprises two pressure relief valves connected by means of the cross-over oil passages to the ports of the at least one hydraulic motor.

5. The hydraulic steering arrangement as recited in claim 1, wherein the cross-over safety block comprises two pressure relief valves connected by means of the cross-over oil passages to the ports of the at least one hydraulic motor.

6. The hydraulic steering arrangement as recited in claim 1, wherein the cross-over safety block comprises one pressure relief valve connected via four check valves and by means of the cross-over oil passages to the ports of the at least one hydraulic motor.

7. The hydraulic steering arrangement as recited in claim 1, wherein the cross-over oil passages have a first flow capacity and the hydraulic pipe portions have a second flow capacity, the first flow capacity being at least 5 to 10 times the second flow capacity for maintaining pipe pressure within acceptable limits.

8. The thruster of a marine vessel as recited in claim 1, wherein the safety valve of the counterbalance block comprises two pressure relief valves.

9. The thruster of a marine vessel as recited in claim 1, wherein the safety valve of the counterbalance block comprises one pressure relief valve connected via four check valves.

10. A thruster of a marine vessel, the thruster comprising:

a propeller unit, a substantially vertical housing and a steering arrangement;

the vertical housing being arranged rotatable by means of bearings within a support frame, the steering arrangement having a hydraulic oil tank in fluid communication with at least one hydraulic motor used for steering the thruster via at least one hydraulic pump, a control valve block, a counterbalance block, and a cross-over safety block, the at least one hydraulic motor being attached to the support frame and having ports for a hydraulic oil the counterbalance block includes a safety valve, the cross-over safety block connected to, and in fluid communication with, the counterbalance block by hydraulic pipe portions, the cross-over safety block connected to, and in fluid communication with, the ports of the at least one hydraulic motor by of cross-over oil passages, the cross-over oil passages dimensioned for higher volumetric flows than the hydraulic pipe portions.

11. The thruster of a marine vessel as recited in claim 10, wherein the cross-over safety block is arranged on the at least one hydraulic motor at an upper end of the thruster.

12. The thruster of a marine vessel as recited in claim 10, wherein the cross-over safety block comprises at least one pressure relief valve connected by means of the cross-over oil passages to the ports of the at least one hydraulic motor.

13. The thruster of a marine vessel as recited in claim 10, wherein the cross-over safety block comprises two pressure relief valves connected by means of the cross-over oil passages to the ports of the at least one hydraulic motor.

14. The thruster of a marine vessel as recited in claim 10, wherein the cross-over safety block comprises one pressure relief valve connected via four check valves and by means of the cross-over oil passages to the ports of the at least one hydraulic motor.

15. The thruster of a marine vessel as recited in claim 10, wherein the cross-over oil passages have a first flow capacity and the hydraulic pipe portions have a second flow capacity, the first flow capacity being at least 5 to 10 times the second flow capacity for maintaining pipe pressure within acceptable limits.

16. The thruster of a marine vessel as recited in claim 10, wherein the safety valve of the counterbalance block comprises two pressure relief valves.

17. The thruster of a marine vessel as recited in claim 1, wherein the safety valve of the counterbalance block comprises one pressure relief valve connected via four check valves.

* * * * *